US006170210B1

(12) United States Patent
Marts

(10) Patent No.: US 6,170,210 B1
(45) Date of Patent: Jan. 9, 2001

(54) CONTINUOUS GEAR HINGE WITH INTUMESCENT SEALS

(75) Inventor: Ronald J. Marts, St. Louis, MO (US)

(73) Assignee: C. Hager & Sons Hinge Manufacturing Company, St. Louis, MO (US)

( * ) Notice: Under 35 U.S.C. 154(b), the term of this patent shall be extended for 0 days.

(21) Appl. No.: 09/270,582

(22) Filed: Mar. 16, 1999

(51) Int. Cl.[7] ..... E04C 2/00

(52) U.S. Cl. ..... 52/232; 52/204.1; 52/656.4; 52/216; 52/656.2; 16/354; 49/399

(58) Field of Search ..... 52/204.1, 211, 52/213, 216, 317, 656.2, 582.2, 656.3, 656.4, 656.9, DIG. 6, 232; 16/354; 44/399, 400

(56) References Cited

U.S. PATENT DOCUMENTS

| | | | | |
|---|---|---|---|---|
| Re. 35,618 | * | 10/1997 | Goossens | 16/354 |
| 3,402,422 | * | 9/1968 | Baer | 16/163 |
| 3,422,487 | * | 1/1969 | Dickinson et al. | 16/354 |
| 3,955,330 | | 5/1976 | Wendt . | |
| 3,964,214 | | 6/1976 | Wendt . | |
| 4,045,930 | | 9/1977 | Dixon . | |
| 4,144,688 | | 3/1979 | Dixon . | |
| 4,354,304 | | 10/1982 | Dixon . | |
| 4,649,089 | | 3/1987 | Thwaites . | |
| 4,660,338 | | 4/1987 | Wagner . | |
| 4,663,204 | * | 5/1987 | Langham | 52/232 X |
| 4,931,339 | | 6/1990 | Malcolm-Brown . | |
| 4,993,203 | | 2/1991 | Tanaka et al. . | |
| 5,062,181 | * | 11/1991 | Bobbowski et al. | 16/354 |
| 5,172,452 | | 12/1992 | Brown . | |
| 5,279,087 | | 1/1994 | Mann . | |
| 5,337,451 | * | 8/1994 | Goossens | 16/354 |
| 5,355,625 | | 10/1994 | Matsuoka . | |
| 5,483,771 | * | 1/1996 | Herbst | 52/204.1 X |
| 5,492,208 | | 2/1996 | Goossens . | |
| 5,685,045 | | 11/1997 | Lace . | |
| 5,765,332 | * | 6/1998 | Landin et al. | 52/317 X |
| 5,845,439 | * | 12/1998 | Hendley | 52/204.1 |
| 5,934,030 | * | 8/1999 | McDonald | 52/204.1 |
| 5,950,376 | * | 9/1999 | Kemeny et al. | 52/232 X |
| 6,073,310 | * | 6/2000 | Baer | 16/354 |

* cited by examiner

*Primary Examiner*—Carl D. Friedman
*Assistant Examiner*—Phi Dieu Tran A
(74) *Attorney, Agent, or Firm*—Polster, Lieder, Woodruff & Lucchesi, L.C.

(57) ABSTRACT

A continuous gear hinge, having extruded aluminum leaves and an extruded aluminum cap which holds the leaves together at meshed gear segments on the leaves, has the capacity to establish a seal between the door and hinge jamb to which it is attached. That seal derives from intumescent strips which lie in recesses that open out of the of the leaves. In the presence of a fire, the intumescent material, the strips of which extend the full length of the hinge, expands and bonds to the door and hinge jamb to not only seal the space between the two, but also to secure the door should the hinge lose its capacity to hold the door.

20 Claims, 2 Drawing Sheets

CONTINUOUS GEAR HINGE WITH INTUMESCENT SEALS

CROSS-REFERENCE TO RELATED APPLICATIONS

STATEMENT REGARDING FEDERALLY SPONSORED RESEARCH OR DEVELOPMENT

Not Applicable.

BACKGROUND OF THE INVENTION

This invention relates to door hinges and, more particularly, to a continuous gear hinge that contains an intumescent seal.

The typical door is supported in a door frame with several hinges, each having two leaves provided with alternate knuckles that are held together with a hinge pin. Being manufactured from steel, these hinges can withstand the heat of a fire and indeed will continue to secure a door as long as the door and the frame in which it fits remain in place in the presence of the fire. But the typical knuckle-type hinge attaches a door to its frame in only a limited area, and while several are used on each door, the hinges remain vulnerable to abuse. It is not uncommon for the knuckle-type hinges on high-use doors, such as the doors one might find at the entrances to schools, to pull away from the edges of the doors or from the hinge jambs of their door frames. Resecuring the hinges with longer screws solves the problem temporarily, but often these screws eventually pull away from the doors or hinge jambs also.

Continuous or gear-type hinges provide a more practical solution to the problem of abuse. The leaves of this type of hinge have gear segments which mesh and also a cap which fits over and behind the gear segments to hold them together while allowing them to pivot relative to each other. The leaves may and often do correspond in length to the length of the door and door jamb and thus attach to the door and jamb at numerous locations, along the door edge and jamb. Hence, they do not easily pull away from either. But aluminum from which the leaves and cap are extruded melts at a relatively low temperature. In the event of a fire the exposed cap and gear segments of the gear hinge may melt, leaving the door unattached along its hinge jamb. A gust of wind or stream of water directed against the door could cause the door to fall out of its frame and enable the fire to propagate through and beyond the door frame. Even if the door remains in place, fire and smoke may pass through the gap left between the door edge and hinge jamb.

For this reason some gear hinges have stainless steel studs which, when the hinge is closed, project through the two leaves and into the hinge jamb and door to which the hinge is attached. In the event of a fire having enough intensity to melt the gear segments and cap, the studs remain in place and secure the door in the frame. But the hinge requires additional manual labor to accommodate the studs, and this adds to the cost of the hinge. Moreover, the studs complicate the installation of the hinge on a door and door frame and may even be removed or left off during installation.

BRIEF SUMMARY OF THE INVENTION

The present invention resides in a continuous gear hinge having recesses in its leaves. The recesses contain seals formed from an intumescent material which expands when heated and has the capacity to fill a gap left between a door edge and hinge jamb. The expanded intumescent material from the hinge bonds to the door and hinge jamb together and secures the door with enough rigidity to keep it in place. It further creates a barrier between the edge of the door and the hinge jamb. The invention also consists in the parts and in the arrangements and combinations of parts hereinafter described and claimed.

BRIEF DESCRIPTION OF THE SEVERAL VIEWS OF THE DRAWINGS

In the accompanying drawings which form part of the specification and wherein like numerals and letters refer to like parts wherever they occur.

DETAILED DESCRIPTION OF THE INVENTION

Figure 1:
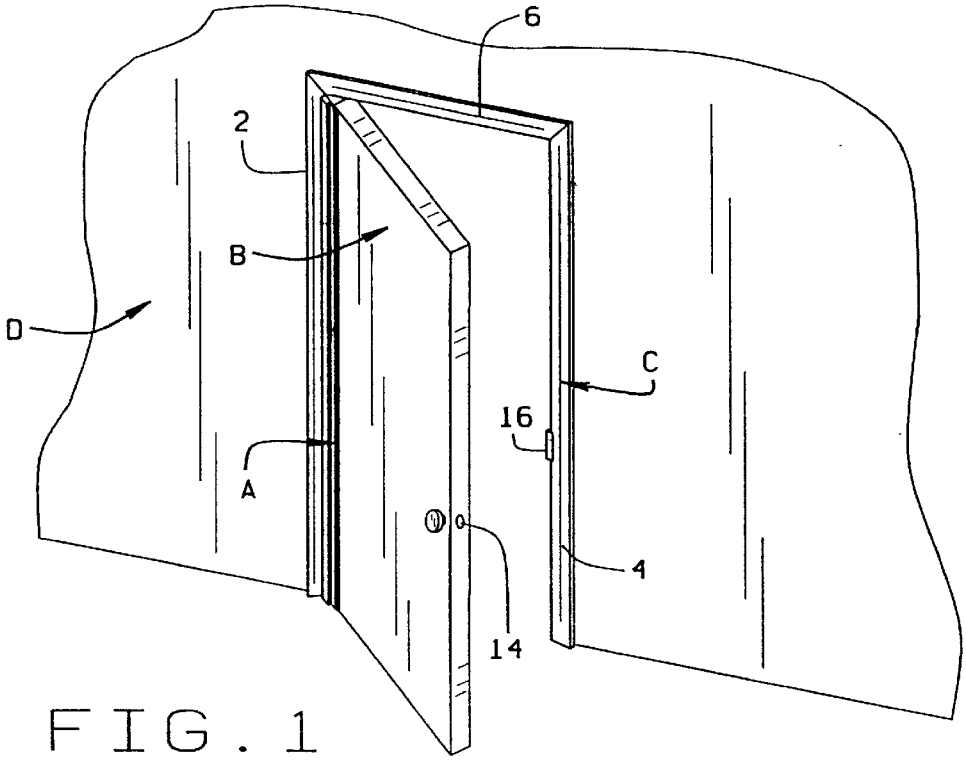
FIG. 1 is a perspective view of a wall containing a door frame to which a door is attached with a continuous gear hinge constructed in accordance with and embodying the present invention.

Referring to the drawings (FIG. 1), a continuous gear hinge A supports a door B in a door frame C which in turn borders a door opening in a wall D. Typically, the door B and door frame C are made from a material, such as steel, which can withstand elevated temperatures without melting or being consumed. The same holds true for the wall D. The hinge, on the other hand, is for the most part, manufactured from aluminum which melts at about 1200° F., which is considerably lower than the melting point for steel which exceeds 2100° F., and a fire opposite either face of the door, but particularly, the face where the hinge A is exposed, could produce enough heat and temperatures high enough to melt at least some of the hinge A. Even though the hinge A melts and becomes ineffective, the door B remains in the door frame C, and will withstand moderate gusts of wind or a stream of water directed against it with moderate force all without leaving the door frame C. Also, fire and smoke will not pass through the space occupied by the hinge A, even in the absence of the hinge.

The wall D is typical. It may be of masonry construction or wood or metal studs covered with a gypsum wallboard. The door frame C, which is set into the wall D is likewise conventional. It has the usual hinge jamb 2 and strike jamb 4 connected by a lintel 6. It is preferably formed from a material, such as steel, which will withstand elevated temperatures—certainly higher than those at which aluminum melts—without melting or being consumed. The two jambs 2 and 4 and the lintel 6 have the usual stops 8 (FIG. 2) which prevent the door B from moving through the frame B, but not out of one end of it.

The door C is also preferably formed from a material that does not melt and is not consumed at the temperature at which aluminum melts. Again steel serves the purpose well. The door C has vertical side edges 10 and 12 (FIGS. 1 and 2) which lie along the hinge jamb 2 and strike jamb 4, respectively. Along its side edge 12, the door B carries a lock having a latch bolt 14 which engages a keeper 16 in the strike jamb 4, but can be withdrawn from the keeper 16 so that the door B may swing away from the door frame C on the hinge A.

Figure 3:
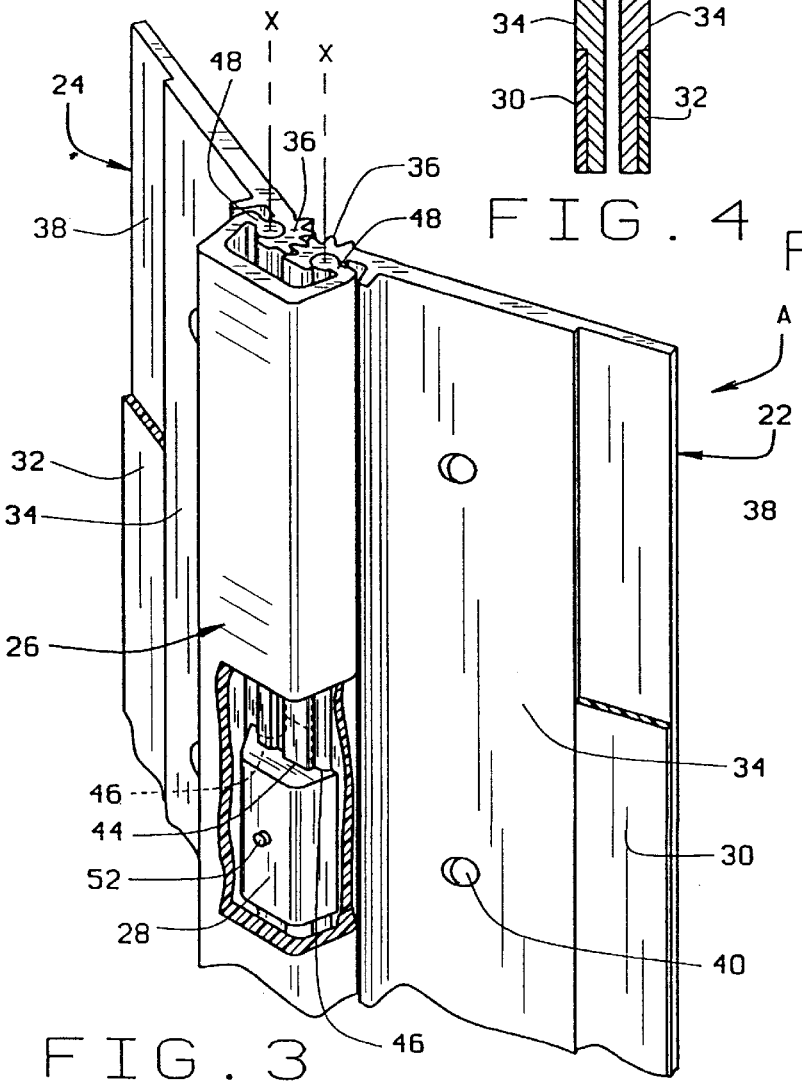
FIG. 3 is a perspective view of the hinge in its open condition.

The hinge A attaches the door B to the hinge jamb 2 of the door frame C for the full height of the door B, yet allows the door B to swing toward and away from the door frame C when the latch bolt 14 is disengaged from the keeper 16. The hinge A includes (FIG. 3) a door leaf 22 and a jamb leaf 24 and also a cap 26 which holds the two leaves 22 and 24 together. All three are aluminum extrusions. In addition, the hinge A has bearing 28 blocks that are located along its leaves 22 and 24 and behind its cap 26 to prevent the leaves 22 and 24 from shifting longitudinally with respect to each other. Finally, the hinge A in its jamb leaf 22 contains a seal 30 of intumescent material and in its hinge leaf 24 contains another seal 32 of intumescent material. The seals 30 and 32 of intumescent material extend the full length of the hinge A.

Each leaf 22 and 24 has (FIG. 3) an elongated mounting plate 34 and a gear segment 36 located along one of the longitudinal edges of the plate 34. Indeed, the plate 34 and gear segment 36 are formed integral as a single aluminum extrusion. The gear segment 36 on each plate 34 projects outwardly as a continuation of the plate 34 to which it is attached and further curves backwardly about the axis X of the segment 36 to project beyond the back surface of the plate 34. In this regard, the plates 34 of the two leaves 22 and 24 have front faces which are presented toward each other when the hinge A is closed and back faces which are presented away from each other when the hinge A is closed. Along its opposite longitudinal edge the mounting plate 34 of each leaf 22 and 24 has a shallow recess 38, in the form of a rabbet, that opens out of the back face of and extends the full length of the plate 34. In the region between its recess 38 and the longitudinal edge from which the gear segment 36 projects, the mounting plate 34 has several countersunk holes 40, with the countersinks opening out of the front face. The gear segment 36 of course has gear teeth and they project outwardly away from the axis X for the segment 36. In addition, the segment 36 has an arcuate bearing surface 42 which lies behind the gear teeth and is presented toward the axis X. Finally, the gear segment 36 has several cutouts 44, the upper and lower surfaces of which lie in planes perpendicular to the axis X of the segment 36.

The gear segments 36 of the two hinge leaves 22 and 24 mesh with each other, and when properly meshed, the cutouts 44 of those segments 36 align. The bearing blocks 28 fit into the aligned cutouts 44 and prevent the hinge leaves 22 and 24 from shifting longitudinally with respect to each other. Each bearing block 28 along its side has arcuate grooves 46, the surfaces of which register with and lie flush with the arcuate bearing surfaces 42 in the gear segments 36 for the two leaves 22 and 24.

The cap 26 fits over and behind the gear segments 36 for the two leaves 22 and 24 so that the gear segments 36 remain together and meshed. In this regard, the cap 26 has ribs 48 which project from its sides inwardly toward each other and terminate at cylindrical surfaces 50 which correspond in curvature to the arcuate bearing surfaces 42 on the gear segments 36 and the arcuate grooves 46 on the bearing blocks 28. Indeed, the ribs 48 project toward the arcuate bearing surfaces 42 and into the grooves 46 where their cylindrical surfaces 50 bear against the arcuate bearing surfaces 42 and the surfaces of the arcuate grooves 46. The cap 26 is installed over the gear segments 36 of the two leaves 22 and 24 by aligning the cylindrical surfaces 50 on the ribs 48 of the cap 26 with the arcuate bearing surfaces 42 on the gear segments 36 of the two leaves 22 and 24 when the gear segments are meshed, and then sliding the cap 26 over the gear segments 36. In so doing, the cylindrical surfaces 50 on the ribs 48 of the cap 26 move along the arcuate bearing surfaces 42 on the gear segments and through the grooves 46 in the bearing blocks 28. The bearing blocks 28 contain set screws 52 which, when turned down, bear against the cap 26 to prevent the cap 26 from sliding relative gear segments 36 of the two leaves 22 and 24.

The intumescent seal 30 for the door leaf 22 occupies the recess 38 that opens out of the back face of the mounting plate 34 for that leaf 22. Likewise, the intumescent seal 32 for the jamb leaf 24 fits into the recess 38 of the mounting plate 34 for that leaf 24. Each recess 38 is preferably about 0.050 inches deep and about 0.500 inches wide. It extends the full length of the leaf 22 or 24. The seal 30 completely fills the recess 38 in the mounting plate 34 for the leaf 22 and lies flush with the back face of that plate 34. Similarly, the seal 32 completely fills the recess 38 in the mounting plate 34 for the leaf 24 and lies flush with the back face of that plate 34. The seals 30 and 32 are attached to their respective mounting plates 34 with an adhesive, and they remain with hinge leaves 22 and 24 during handling. A (GIS) graphite intumescent material having an adhesive backing is suitable for the two seals 30 and 32. This material, when heated above 392° F. (200° C.), seeks to expand—indeed, six to twelve fold and normally about eight fold. The 3M Company, under the designation 3M Interam G-Mat, sells an intumescent material that is suitable for the seals 30 and 32.

Figure 2:
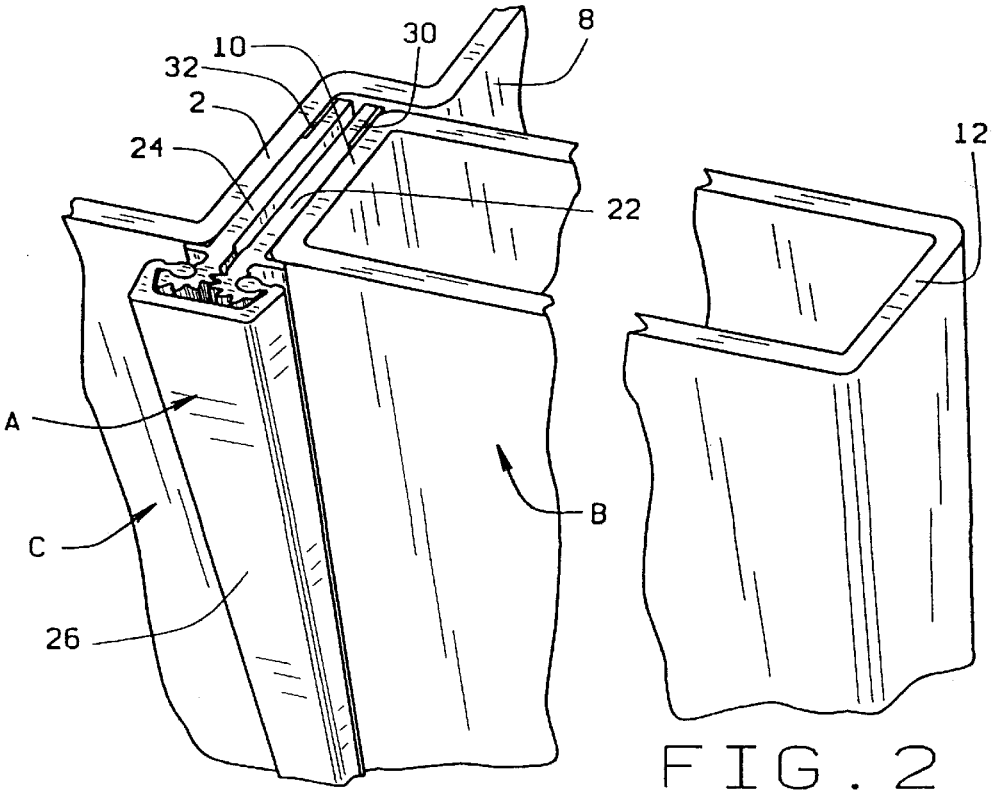
FIG. 2 is a fragmentary perspective view in section with the hinge attached to the door and the door closed.
Figure 4:
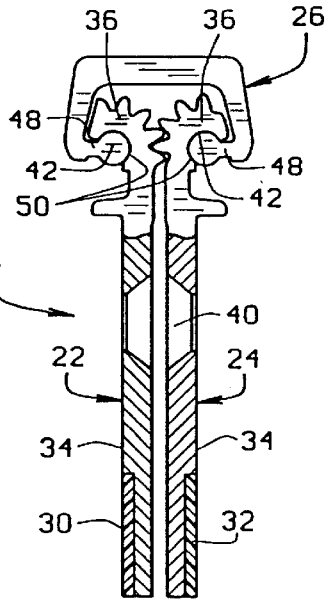
FIG. 4 is a sectional view of the hinge alone.

The hinge A is installed in the door B with the back face of the mounting plate 34 for the door leaf 22 being against the side edge 10 of the door B (FIG. 2). It is secured with screws which pass through countersunk holes 40 in the mounting plate 34 and thread into the door B. When so installed, the gear segment 36 projects beyond the face of the door B, while the intumescent seal lies captured between the mounting plate 34 of the door leaf 22 and the side edge 10 of the door B. On the other hand, the jamb leaf 24 is secured against the hinge jamb 2 ahead of the stop 8 on that jamb 2. The back face of its mounting plate 34 abuts the hinge jamb 2 while the gear segment 36 projects beyond the jamb 2. Thus, the intumescent seal 32 for the jamb leaf 24 lies captured between the mounting plate 34 for that leaf and the hinge jamb 2. The mounting plate 34 of the jamb leaf 24 is secured against the hinge jamb 24 with screws which pass through the countersunk holes 40 in that mounting plate and thread into the hinge jamb 2 or the wall D behind it or both. Since the seals 30 and 32 lie behind the mounting plates 34 of their respective leaves 22 and 24, they are protected from inadvertent damage and vandalism.

The hinge A permits the door B to swing toward and away from the door frame C, and as it does the gear segment 36 of the door leaf 22 moves over the gear segment 36 of the jamb leaf 24, while the teeth on the two gear segments 36 remain meshed in that they are held together by the cap 26. The cap 26 accommodates the movement in that the arcuate bearing surfaces 42 in the gear segments 36 move over the cylindrical surfaces 50 on the ribs 48 of the cap 26, the rotation being about the axes X.

The door B, if closed and secured to the strike jamb 4 with the latch bolt 14, will isolate one side of the wall D from the other and prevent a fire from propagating through the wall D. The door B and door frame C as well as the bolt 14 and keeper 16 can withstand intense heat that produces elevated temperatures, in that they are formed from steel or some other fire resistant material. But the hinge A, being formed from aluminum will not, since aluminum melts at about 1200° F. Indeed, in the presence of an intense fire, particularly opposite the end of the door frame C out of which the door B opens, the cap 26 and gear segments 36 of the hinge leaves 20 and 24 will melt and no longer secure the door B in the frame C. But by that time, the intumescent material of the two seals 30 and 32 will have also expanded. The material of the seal 30, upon expanding bonds to the side edge 10 of the door B and spreads into the gap between the side edge 10 and the hinge jamb 2. The material of the seal 32, on the other hand, bonds to the hinge jamb 2 and also expands into the gap between the jamb 2 and side edge 10 of the door B. Indeed, the expanded material of either seal 30 or 32 will spread far enough to completely bridge the gap and bond to the jamb 2 and edge 10 on both sides of the gap. But in most instances the material of the seal 30 expands into the material of the seal 32 and the two expanded seals become united in the gap between the hinge jamb 2 and the side edge 20 of the door B. The expanded intumescent material of the seals 30 and 32 prevents flames and smoke from passing through the gap. Moreover, the expanded seals 30 and 32 secure the side edge 10 of the door B to the hinge jamb 2 and thus prevent the door B from falling out of the door frame C when subjected to a gust of wind or a stream of water.

Figure 5:
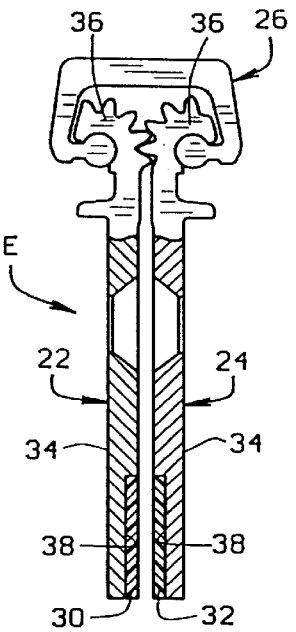
FIG. 5. is a sectional view of a modified hinge.

A modified continuous gear hinge E (FIG. 5.), like the hinge A, has a door leaf 22 and a jamb leaf 24, each with its own mounting plate 34 and gear segment 36. In addition, the hinge E has a cap 26 which fits over the gear segments 36 of the two leaves 22 and 24 and maintains them meshed. Likewise, the mounting plates 34 for the leaves 22 and 24 of the hinge E have shallow recesses 38, but in contrast to the hinge A, the recesses 38 open out of the front faces of the leaves 22 and 24. The recess 38 of the leaf 22 contains a strip 30 of intumescent material, whereas the recess 38 of the leaf 24 contains another strip 32 of intumescent material.

When the hinge E in the regions of the recesses reaches about 400° F., the intumescent material of the two strips 30 and 32 expands and establishes a seal between the hinge jamb 2 of the door ram C and the side edge 10 of the door B.

In either of the hinges A or E only one of the leaves 22 or 24 may contain a strip 30 or 32 of intumescent material.

This invention is intended to cover all changes and modifications of the example of the invention herein chosen for purposes of the disclosure which do not constitute departures from the spirit and scope of the invention.

Hager Hinge Company
Parts List

Continuous Gear Hinge With Intumescent Seals

A continuous gear hinge
B door
C doorframe
D wall
X axis
2. hinge jamb
4. strike jamb
6. lintel
8. stops
10. side edge
12. side edge
14. bolt
16. keeper
22. doorleaf
24. jamb leaf
26. cap
28. bearing block
30. strip of intumescent material
32. strip of intumescent material
34. mounting plate
36. gear segment
38. shallow recess
40. countersunk holes
42. arcuate bearing surface
44. cutouts
46. arcuate grooves
48. ribs
50. cylindrical surface
52. set screws

What is claimed is:

1. A continuous gear hinge comprising: a first leaf having an elongated mounting plate and a gear segment along one side of the plate; a second leaf having an elongated mounting plate and a gear segment along one side of the plate, the gear segment of the second leaf meshing with the gear segment of the first leaf; a cap fitted over and behind the gear segments of the first and second leaves to hold the gear segments together and meshed, yet to allow the leaves to pivot relative each other; and an intumescent material carried by at least one of the leaves and extending substantially the full length of that leaf.

2. A hinge according to claim 1 wherein each leaf carries an intumescent material that extends substantially the full length of the leaf.

3. A hinge according to claim 1 wherein the leaves and the cap are formed from aluminum.

4. A hinge according to claim 1 wherein the leaves pivot between open and closed positions and have front faces which are presented toward each other when the leaves are in the closed position and back faces which are presented away from each other when the leaves are in the closed position; and wherein the intumescent material is along the back face of the first leaf.

5. A hinge according to claim 4 wherein the intumescent material is in the form of a strip that extends along the back face of the first leaf for substantially the entire length of the back face.

6. A hinge according to claim 5 wherein the mounting plate of the first leaf contains a recess which extends substantially the full length of the mounting plate and opens out the back face of the mounting plate; and the strip of intumescent material is in the recess.

7. A hinge according to claim 6 wherein the mounting plate of the second leaf contains a recess which extends substantially the full length of the mounting plate and opens out of the back face of the mounting plate and another strip of intumescent material is in the recess of the mounting plate for the second leaf.

8. A hinge according to claim 7 wherein the strips of intumescent material lie substantially flush with the back faces of the mounting plates.

9. A hinge according to claim 7 wherein the recesses extend along and open out of the other sides of the mounting plates for the first and second leaves to form rabbets in the leaves.

10. A hinge according to claim 9 wherein each recess is not more than about 0.050 inches deep.

11. A hinge according to claim 1 wherein the leaves pivot between open and closed positions and have front faces which are presented toward each other when the leaves are in the closed position and back faces which are presented away from each other when the leaves are in the closed position; and wherein the intumescent material is along the front face of the first leaf.

12. A hinge according to claim 5 wherein the mounting plate of the first leaf contains a recess which extends substantially the full length of the mounting plate and opens out the front face of the mounting plate; and the strip of intumescent material is in the recess.

13. A hinge according to claim 6 wherein the mounting plate of the second leaf contains a recess which extends substantially the full length of the mounting plate and opens out of the front face of the mounting plate and another strip of intumescent material is in the recess of the mounting plate for the second leaf.

14. In combination with a door frame having a hinge jamb and a door having a side edge, a continuous gear hinge connecting the door to the door frame such that the door can swing outwardly from the frame, said hinge comprising: a jamb leaf having a mounting plate that is attached to the hinge jamb of the door frame and a gear segment located along one side of the mounting plate; a door leaf having a mounting plate that is attached to the side edge of the door and a gear segment located along one side of the mounting plate, the gear segment of the door leaf meshing with the gear segment of the jamb leaf; a cap extended over and behind the gear segments of the two leaves to hold the gear segments together and meshed, yet to allow the door leaf to pivot relative to the jamb leaf when the door is moved between open and closed positions; a first strip of intumescent material located along the mounting plate of the jamb leaf; and a second strip of intumescent material located along the mounting plate of the door leaf.

15. The combination according to claim 14 wherein the first strip of intumescent material is attached to the mounting plate of the jamb leaf and the second strip of intumescent material is attached to the mounting plate of the second leaf.

16. The combination according to claim 15 wherein the mounting plate of the jamb leaf contains a recess which opens toward the hinge jamb and the first strip is located in that recess; and wherein the mounting plate of the door leaf contains a recess which opens toward the side edge of the door and the second strip is in that recess.

17. The combination according to claim 16 wherein the recesses in the mounting plates of the jamb and door leaves also open out of the side edges of those leaves.

18. The combination according to claim 17 wherein the strips of intumescent material are about as thick as the recesses in which they are located are deep.

19. The combination according to claim 14 wherein the mounting plate of one of the leaves contains a recess which opens toward the other leaf when the hinge is closed, and the strip of intumescent material for that leaf is in the recess.

20. The combination according to claim 14 wherein the mounting plates of the leaves contain recesses which open toward each other when the hinge is closed, and the strips of intumescent material are in the recesses.

* * * * *